United States Patent [19]

Targetti

[11] Patent Number: 4,636,924

[45] Date of Patent: Jan. 13, 1987

[54] ASSEMBLY WITH A LAMP TO BE EMBEDDED HAVING A MEMBER THAT CAN BE ENGAGED IN THE EMBEDDING SEAT AND FORMING THE HOUSING FOR THE LAMP

[75] Inventor: Giampaolo Targetti, Florence, Italy

[73] Assignee: Targetti Sankey S.p.A., Florence, Italy

[21] Appl. No.: 772,777

[22] Filed: Sep. 5, 1985

[30] Foreign Application Priority Data

Sep. 18, 1984 [IT] Italy ..... 11823/84[U]

[51] Int. Cl.[4] ..... F21V 21/04

[52] U.S. Cl. ..... 362/277; 362/364; 362/365; 362/404

[58] Field of Search ..... 362/277, 365, 364, 147, 362/282, 319, 368, 433, 440, 370, 427, 322, 350, 449, 435; D26/118, 128

[56] References Cited

U.S. PATENT DOCUMENTS 2,554,258 5/1951 Lundquist ..... 362/364
3,370,165 2/1968 Chan ..... 362/364

FOREIGN PATENT DOCUMENTS 3013715 10/1981 Fed. Rep. of Germany ..... 362/364

*Primary Examiner*—William A. Cuchlinski, Jr.
*Assistant Examiner*—D. M. Cox
*Attorney, Agent, or Firm*—Hopgood, Calimafde, Kalil, Blaustein & Judlowe

[57] ABSTRACT

An assembly with a lamp to be embedded, comprising: a member with annular development with a cylindrical wall and two flanges, one inside and the other outside suitable to place itself against the mouth of the embedding seat; in said member a housing suitable to receive with elastic yielding the lamp to be embedded; appendixes rising from said annular member towards the inside of the embedding seat, which engage spring type means for retaining said member within the embedding seat; and in the lamp a spherical surface that is received in said housing and allows the lamp orientation.

4 Claims, 6 Drawing Figures

55
53
1
1
II
II
10
5
10
103
3
12x
31
12A
f12
103
12A
12
12
S
37
33
III
III
51

51
35x
38
35
35A
35A
53
5
101
10
12A
12
55
39
12
12A
101
10
33
36

ASSEMBLY WITH A LAMP TO BE EMBEDDED HAVING A MEMBER THAT CAN BE ENGAGED IN THE EMBEDDING SEAT AND FORMING THE HOUSING FOR THE LAMP

Object of the Model is an assembly with a lamp to be embedded comprising: a member with annular development with a cylindrical wall and two flanges, one inside and the other outside suitable to place itself against the mount of the embedding seat; in said member a housing suitable to receive with elastic yielding the lamp to be embedded; appendixes rising from said annular member towards the outside of the embedding seat, which engage spring type means for retaining said member within the embedding seat; and in the lamp a spherical surface that is received in said housing and allows the orientation of the lamp.

Said appendixes in practice show a U shaped section with the intermediate portion provided with ladder shaped clefts; within two of said clefts, in each appendix, a spring type element suitable to contrast with the seat can be inserted. The sections of the appendixes are increasing towards the base, that joints with the inside flange of said member. The ladder shaped clefts can be limited by cross-pieces with triangular section, which make easy the operation of spreading apart the elastic elements.

Advantageously the outside flange of the member has clefts that define elastic arms with a grip pawl for a finishing ring nut.

The drawing shows a possible embodiment of the Model, and in particular:

Figure 1:
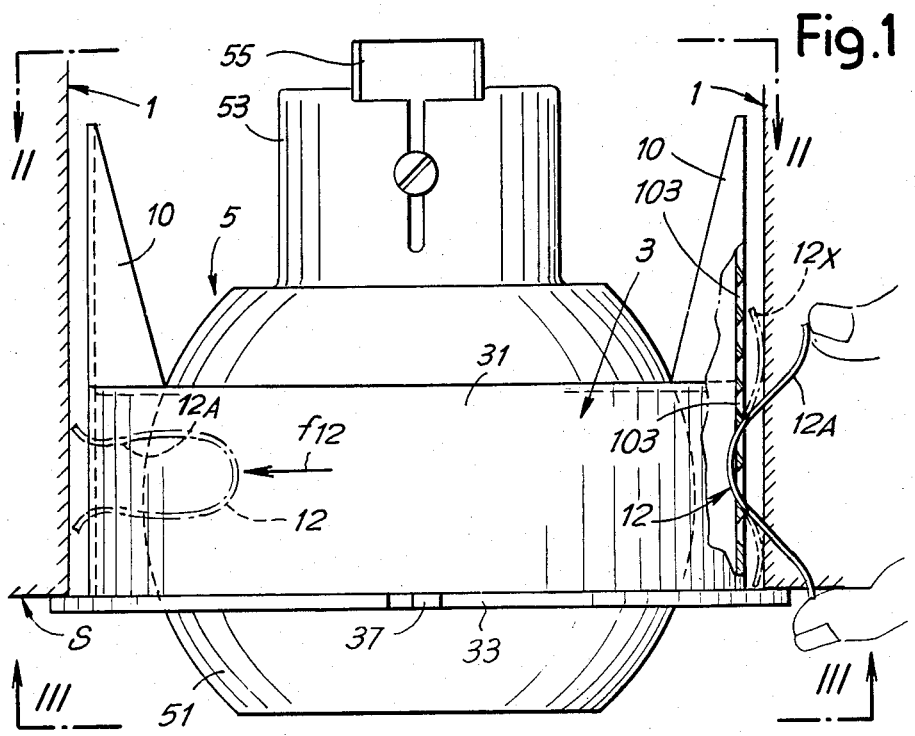
FIG. 1 shows a partial sectional view of an assembly for the application of an embedded lamp that can be oriented.

In the drawing, number 1 indicates a seat in that an assembly according to the invention is suitable to be embedded; this seat will be able to have a substantially cylindrical development in order to receive a member 3 having an annular development with a cylindrical wall 31, an outside flange 33 at one end and an inside flange 35 at the opposite end. The outside edge of the flange 33 shows clefts 36 that delimit elastic arms 37 forming end teeth. The inside flange 35 has an edge 35X and a crown of elastic teeth 38 and 39 of two kinds. The teeth 39 rise in correspondence of a solid portion of the flange 35, while the teeth 38 rise in correspondence of apertures 35A of the flange 35, so that the formation of an external projection 38A in the teeth 38 is allowed, when the piece 3 is realized by injection moulding. All teeth 38 and 39 have inside a profile 38A, 39X oriented inwardly at the elastically flexible end of the respective tooth. The inside flange 35 forms an inside edge 35X, that together with the profiles 38X, 39X defines a housing for the lamp; the edge 35X is stiff while the profiles 38X, 39X are elastically yielding toward the outside, thus defining an annular expansible discontinuous profile for the retaining of the lamp. Number 5 generically indicates the lamp, that has a surface shaped as a sphere segment with an extension 53, where a block 55 is received for the lamp holder, of a type per se known.

The lamp assembly 5 can be inserted within the annular member 3 at the side of the outside flange 33; during the insertion the teeth 38 and 39 expand by the action of the surface 51 shaped as a sphere segment and allow thus the passage of the portion with maximum diameter of said surface; the surface 51 reaches the edge 35X and remains close to it by the effect of the thrust that takes place according to arrow f5 on the surface 51 by the action of teeth 38 and 39, that tend to elastically shrink and thus give rise to a thrust component, in the axial sense according to said arrow f5, on the portion of the surface 51 below the maximum diameter. In this way by the simple insertion operation according to f5, the lamp 5 is received in the housing formed by the edge 35X and by the profiles 38X, 39X and is retained there by the elasticity itself of said teeth.

Figure 4:
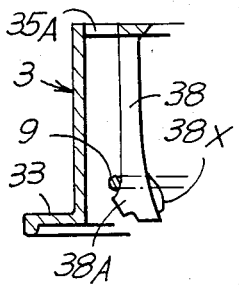
FIGS. 4, 5 and 6 show local sections according to the lines IV—IV, V—V and a partial sectional view according to VI—VI of FIG. 3.
Figure 5:
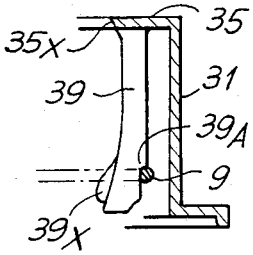
Figure 6:
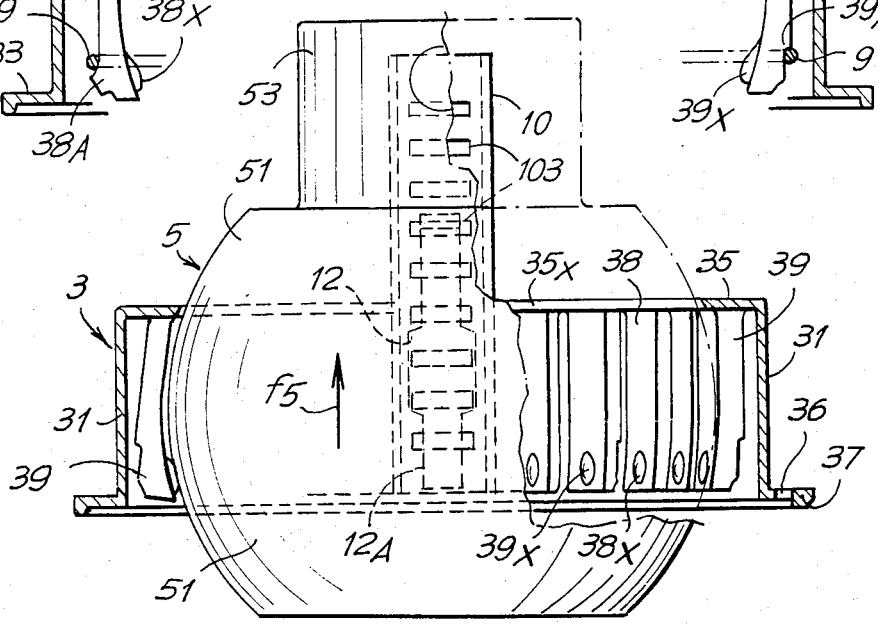

In order to assure a reliable function of elastic retaining of the lamp by the action of the teeth 38 and 39, an elastic metallic expansible ring 9 can be provided, having the tendency to force elastically inwardly the teeth 38 and 39, also when their own elasticity is not sufficient for the purpose, by intervening independently from the elastic effect of the teeth. Therefore, should teeth 38 and 39 not sufficient—either because the fatigue of the material or because the heating due to the heat generated by the lamp—the effect of retaining is assured by the elastic ring. The elastic ring 9 is retained by the external shaping of teeth 38 with the prominence 38A and of the teeth 39 with the step 39A; these shapings prevent respectively a downwards and upwards displacement of the ring$^9$/(looking FIGS. 4 and 5).

The housing formed by the edge 35X and by the profiles 38X and 39X allows the orientation of the lamp spherically within certain limits around the center of the spherical surface 51, so that the lamp can be oriented in the desired way within the housing, in order to project the light in slanting directions respect to the axis of member 3.

Figure 2:
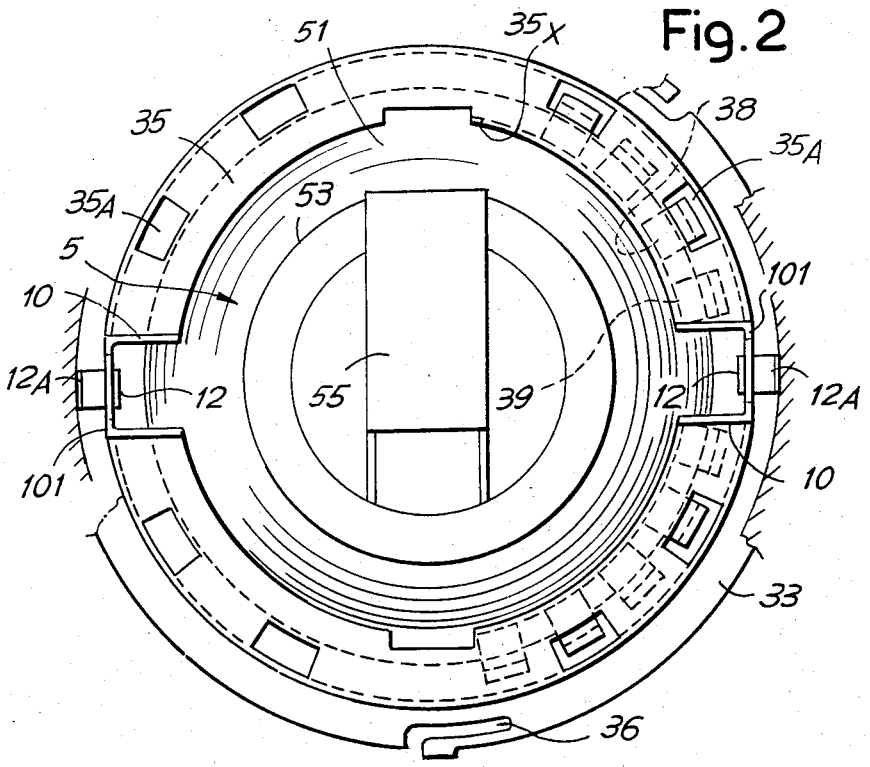
FIG. 2 is a view from the line II—II of FIG. 1.
Figure 3:
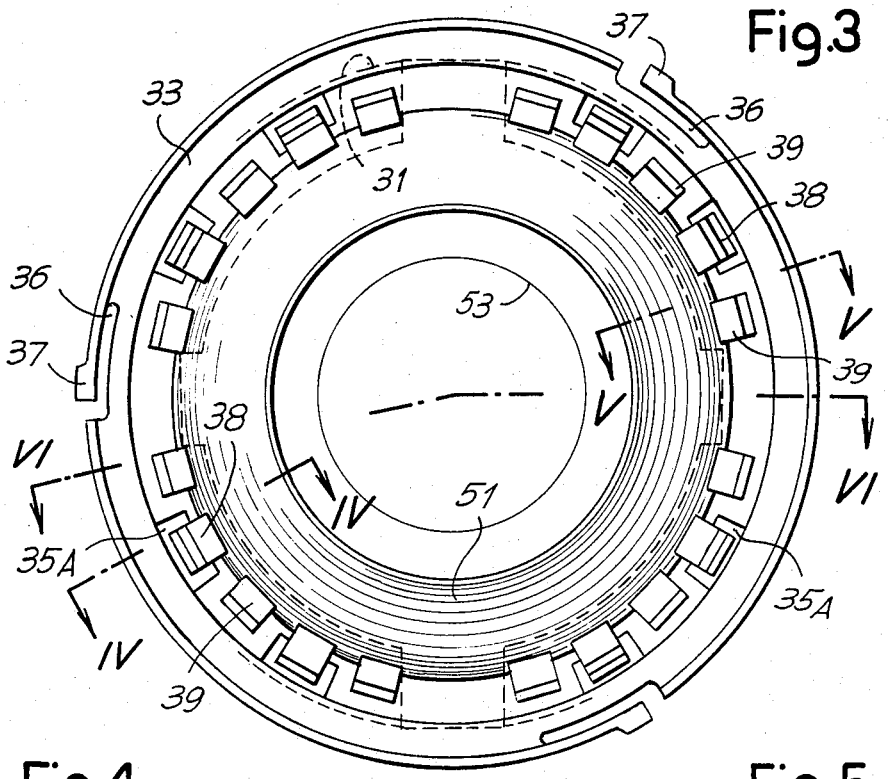
FIG. 3 is a view from the line III—III of FIG. 1.

The member 3 for the engagement in the seat 1 has a couple of appendixes 10 that develop approximately parallel to the axis of the assembly 3 from the inside flange 35, these appendixes 10 having a cross section U-shaped with the cavity oriented towards the inside. The intermediate wall 101 of the appendixes 10, which is external in the assembly, has a series of ladder shaped clefts, defined by cross-pieces with substantially triangular section, as shown in the right side of FIG. 1. In one couple of spaced clefts 103 the two arms 12A of a respective small spring 12 can be inserted, said small spring having the purpose of anchoring the assembly 3 to the wall of the seat 1. The small spring 12 can be preliminarily settled as shown by dashed line on FIG. 1 at the left side, in such a way that the whole small spring is defiled at the inside of the cylindrical wall 1 or at the inside of the continuation of said wall; in order to settle the small spring 12 in these conditions it is enough to act on it by two fingers to approach the two arms 12A as shown at the right side on FIG. 2. After the insertion of the member 3 in the seat 1, it is possible to push each small spring 12 in the sense of the arrow f12 outwards, in such a way that the arms 12A are spread apart and thus assure a retaining effect of the assembly 3 respect to and within the seat 1; all as it is shown in FIG. 1 where the seat 1 appears realized in a relatively thin wall. The application is particularly easy and the length of the appendixes 10 and of the ladders 103 assure the application of the assembly depending on the member 3, for any condition and configuration of the seat 1. When the seat 1 is realized on a thicker wall it for the insertion in it of the member 3 is preferable to deform simultaneously towards the inside of said member the arms 12A of the small springs 12 being oriented towards the seat until the insertion becomes possible; once the insertion has been carried out, the other arms 12, oriented towards the outside, undergo also a deformation while coming into contact with the internal wall of the seat 1 and pressing against it. The application can be realized in such a way that the flange 33 becomes close to the surface S, from which the seat 1 extends and in which the lamp results embedded. This flange can form itself a trimming, but it can also engage a finishing ring nut suitable for surrounding the spherical surface 51 and for covering the flange 33, being this finishing ring nut able to be easily engaged to the teeth 37.

The application of the member 3 is preliminarily carried out before the insertion of the lamp 5 in the housing formed by the member 3, and consequently the handling of the small spring 12 is very easy. After having carried out the electrical connections by free conductors of a certain length coming from the bottom of the seat 1, the lamp 5 may be inserted in the housing and then it is possible to complete aesthetically the application of the ring nut that can be engaged with the teeth of the arms 37. The lamp remains anyway suitable to be oriented around the center of the surface 51 and the engagement and the attitude to be oriented of the lamp can be assured by the open elastic ring 9.

I claim:

1. An assembly to be mounted in a seat for receiving a lamp comprising in combination an annular member with a cylindrical wall provided with upper and lower flanges, said lower flange being configured to engage the mouth of said seat upon mounting of said assembly therein, within said annular member an elastic housing for yieldably supporting a spherical lamp in a plurality of orientations attached to said annular member a plurality of appendages rising therefrom toward the interior of said seat, said appendages being of U-shaped cross section with intermediate ladder-shaped clefts, at least two of which are arranged for receiving a V-shaped spring, said spring being positioned, configured and dimensioned to frictionally secure said assembly in said seat.

2. An assembly as per claim 1, characterized in that the appendages have their sections increasing towards the base that joins to the upper flange of said member.

3. An assembly as per claim 1, characterized in that the ladder shaped clefts are limited by cross pieces having triangular section to facilitate the operation of spreading apart the elastic elements.

4. An assembly as per claim 3, characterized in that the lower flange of the member has clefts that define elastic arms with a grip pawl for a finishing ring nut.

* * * * *